US009049950B2

(12) United States Patent
Wu

(10) Patent No.: US 9,049,950 B2
(45) Date of Patent: Jun. 9, 2015

(54) SHOULDER WARMING SLEEPING BAG EXTENSION

(76) Inventor: Ricky I-wen Wu, Santee, CA (US)

( * ) Notice: Subject to any disclaimer, the term of this patent is extended or adjusted under 35 U.S.C. 154(b) by 309 days.

(21) Appl. No.: 13/493,724

(22) Filed: Jun. 11, 2012

(65) Prior Publication Data

US 2012/0317718 A1 Dec. 20, 2012

Related U.S. Application Data

(60) Provisional application No. 61/520,496, filed on Jun. 11, 2011.

(51) Int. Cl.

| | |
|---|---|
| ***A47G 9/02*** | (2006.01) |
| ***A47G 9/08*** | (2006.01) |
| *A47G 9/04* | (2006.01) |

(52) U.S. Cl.

CPC ..... *A47G 9/08* (2013.01); *A47G 9/0238* (2013.01); *A47G 9/04* (2013.01)

(58) Field of Classification Search

CPC ..... A47G 9/08; A47G 9/083; A47G 9/086; A47G 9/02; A47G 9/0238; A47G 9/04; A41D 1/00; A41D 1/02; A41D 1/04; A41D 11/00; A41D 2400/10

USPC ..... 5/413 R, 413 AM, 494, 482, 655; 2/69, 2/69.5, 83; D2/718–720

See application file for complete search history.

(56) References Cited

U.S. PATENT DOCUMENTS

| | | | | | |
|---|---|---|---|---|---|
| 782,819 | A * | 2/1905 | Bikle | 2/75 |
| 1,332,301 | A * | 3/1920 | Moore | 2/69 |
| 1,875,525 | A * | 9/1932 | Thexton et al. | 5/494 |
| 1,919,154 | A * | 7/1933 | Astrove | 2/69 |
| 2,227,751 | A * | 1/1941 | Idelman | 2/69.5 |
| 2,292,600 | A * | 8/1942 | Baum | 2/69 |
| 2,307,266 | A * | 1/1943 | Hansen | 2/114 |
| 2,338,226 | A * | 1/1944 | Bauer | 5/413 R |
| 2,743,451 | A * | 5/1956 | Meyers | 2/83 |
| 2,757,390 | A * | 8/1956 | Miller | 5/413 R |
| 3,831,206 | A * | 8/1974 | Geary | 5/413 R |
| 4,295,230 | A * | 10/1981 | Blodgett | 2/69.5 |
| 4,688,282 | A * | 8/1987 | Jeffries | 2/69.5 |
| 4,897,885 | A * | 2/1990 | Lunt | 2/69.5 |
| 4,989,282 | A * | 2/1991 | Goldstein | 2/69.5 |
| 5,046,204 | A * | 9/1991 | Mohler | 5/413 R |
| 5,722,094 | A * | 3/1998 | Ruefer | 2/69.5 |
| 5,781,946 | A * | 7/1998 | McEntire et al. | 5/482 |
| 6,266,822 | B1 * | 7/2001 | Joyce | 2/83 |
| D456,661 | S * | 5/2002 | Henegan | D6/608 |
| 6,389,597 | B1 * | 5/2002 | Henegan | 2/69.5 |
| 6,662,390 | B1 * | 12/2003 | Berger | 5/486 |
| 6,817,033 | B2 * | 11/2004 | Bailey | 2/69.5 |
| 7,003,825 | B1 * | 2/2006 | Levings | 5/482 |
| 7,013,507 | B2 * | 3/2006 | Cook | 5/413 R |
| 2012/0317718 | A1 * | 12/2012 | Wu | 5/413 R |

* cited by examiner

*Primary Examiner* — Robert G Santos

(57) ABSTRACT

One embodiment of a sleeping bag extension piece or elongated sleeping bag with sufficient length beyond a traditional sleeping bag to rest upon the sleep surface above the user's shoulder line creating a natural body heat seal and restricting air flow between the sleeping bag top and sleep surface above the shoulder line, and having a separation to allow a user's head to protrude.

2 Claims, 4 Drawing Sheets

SHOULDER WARMING SLEEPING BAG EXTENSION

CROSS REFERENCE

PPA 61/520,496

BACKGROUND

Prior Art

The following is a tabulation of some prior art that presently appears relevant:

| U.S. Patents | | | |
|---|---|---|---|
| Patent Number | Kind Code | Issue Date | Patentee |
| 2,379,416 | A | 1945 Jul. 03 | James Clark |
| 211,138 | A1 | 2010 Aug. 19 | Pierre et al. |
| 4,261,058 | B1 | 1981 Apr. 14 | Buchman |
| 2,338,226 | B1 | 1944 Jan. 04 | Bauer |
| 4,989,282 | B1 | 1991 Feb. 05 | Goldstein |
| 3,717,888 | B1 | 1973-02-1973 | Phelan |
| 4,787,105 | B1 | 1988 Nov. 29 | Phillips et al. |

A traditional rectangular or semi-rectangular sleeping bag often times does not perform an adequate job of keeping the user warm. The image of a user trying to pull the top of a rectangular bag closer to their neck points to the shortfall of that particular design. The human body sets as a priority to keep the vital organs, from the torso to the shoulders, warm. As the temperature in this core region drops, the human body begins to restrict blood to the extremities. This blood restriction can, at a minimum cause discomfort, and can also cause more serious effects such as hypothermia and frostbite in the extremities.

The large top opening through which the head of the user protrudes is the primary cause of unwanted airflow in and out of the rectangular sleeping bag. When the sleeping bag top is pulled above the shoulder line and resting on the neck, air flow persists despite a visual perception that an effective air seal has been established. Sleeping bag designers have traditionally dealt with this problem by making sleeping bags with heavier fill materials than what's needed causing the rest of the body to overheat in order to compensate for the heat leakage from the shoulder region of the user.

Other designs exist to deal with the problem of body heat leaking from the top of a sleep covering. Mummy style sleeping bags, heretofore referred to as mummy bags, add to traditional rectangular sleeping bags a head and shoulder covering around all sides of the bag, reducing the opening to a small facial cutout, thus restricting the body heat leakage. While this can be an effective way to minimize cold air infiltration, mummy bags are very restrictive, allowing for very little body movement within the sleeping bag. The restrictive design of the Mummy bag also does not allow for an ordinary pillow to fit within the bag, requiring either a special smaller camping pillow, or for the user to use the pillow outside the bag. Despite the mummy bag's effectiveness in reducing heat leakage, the market for rectangular bags continues to be healthy due to it's relative cost to produce, and the additional space and resulting comfort of the rectangular shape compared to a mummy bags tighter fit and restrictive hood.

In the case of U.S. Pat. No. 021,138 (2010) and other designs that have utilized a head cutout in sleep coverings, the cutouts have been of minimal length, with enough length to cover the shoulders with an incidental contact patch, a small amount of sleep covering in contact with the sleep surface. The cut out here ends shortly past the shoulder line. While this is more effective than an ordinary straight cut top line blanket, it will continue to allow heat to escape during ordinary body shifting during rest or sleep. The incidental contact patch created by these head cutouts does not seal heat as effectively as the large contact patch created along the sides and bottom of an ordinary blanket.

Others, include U.S. Pat. No. 4,787,105 (1988), and U.S. Pat. No. 3,717,888 (1973) attempt to address the problem of cold air intrusion into a sleeping bag. Phillips contemplates a snorkel device attached to a sleeping bag to allow the user to be completely covered and breathe. The results are expensive sleeping bags to construct that are likely to cumbersome for the average consumer to adopt.

ADVANTAGES

Accordingly several advantages of one or more aspects are as follows: to provide a body heat seal along the top side of a standard rectangular or semi-rectangular sleeping bag by creating a larger than incidental contact patch, the surface area of a sleeping bag top resting against a sleep surface, above the shoulder region of the user with a separation to allow the user to breathe.

DRAWINGS

Figure 1A:
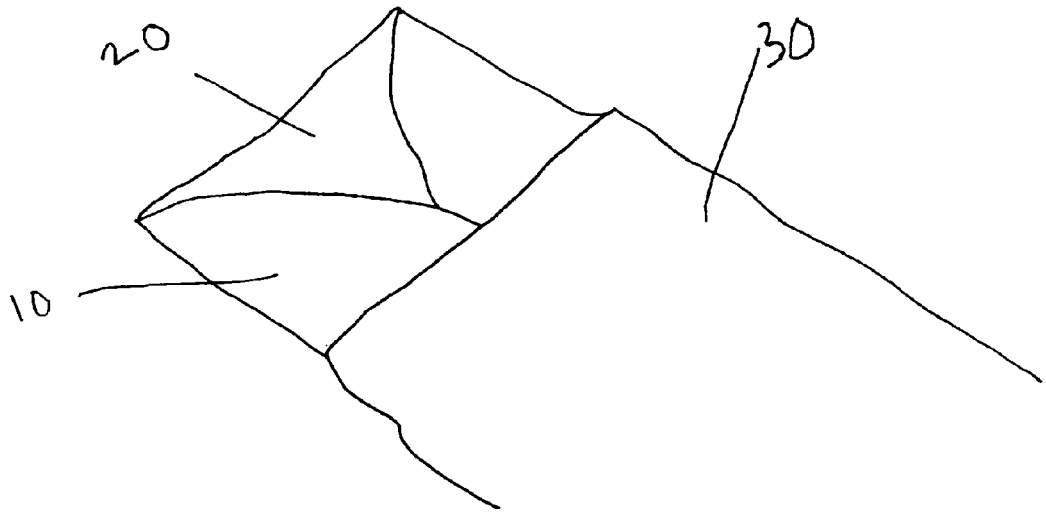
FIGS. 1A and 1B shows various views of a shoulder warming attachment connected to a rectangular sleeping bag.

| Drawings Reference Numerals |
|---|
| 10. Sleeping Bag Extension |
| 20. Extension Bottom Side |
| 30. Sleeping Bag |
| 40. Velcro Fastener on Extension |
| 50. Velcro Fastener on Sleeping Bag |
| 60. Extension Top Side |
| 70. Middle Point of Extension |
| 80. Top Side Separation Meeting Point |
| 90. Width of Separation Halfway Down |

DETAILED DESCRIPTION

Figure 1B:
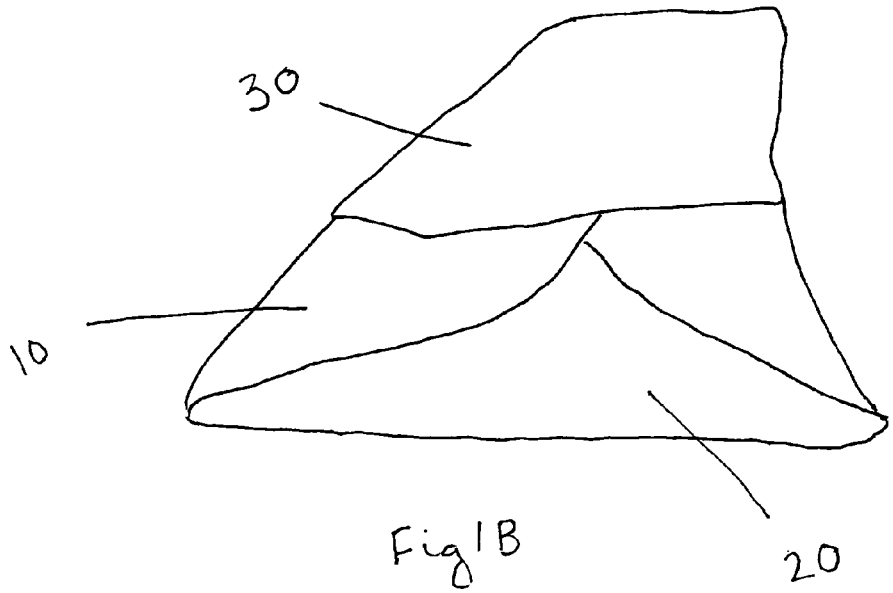
Figure 2:
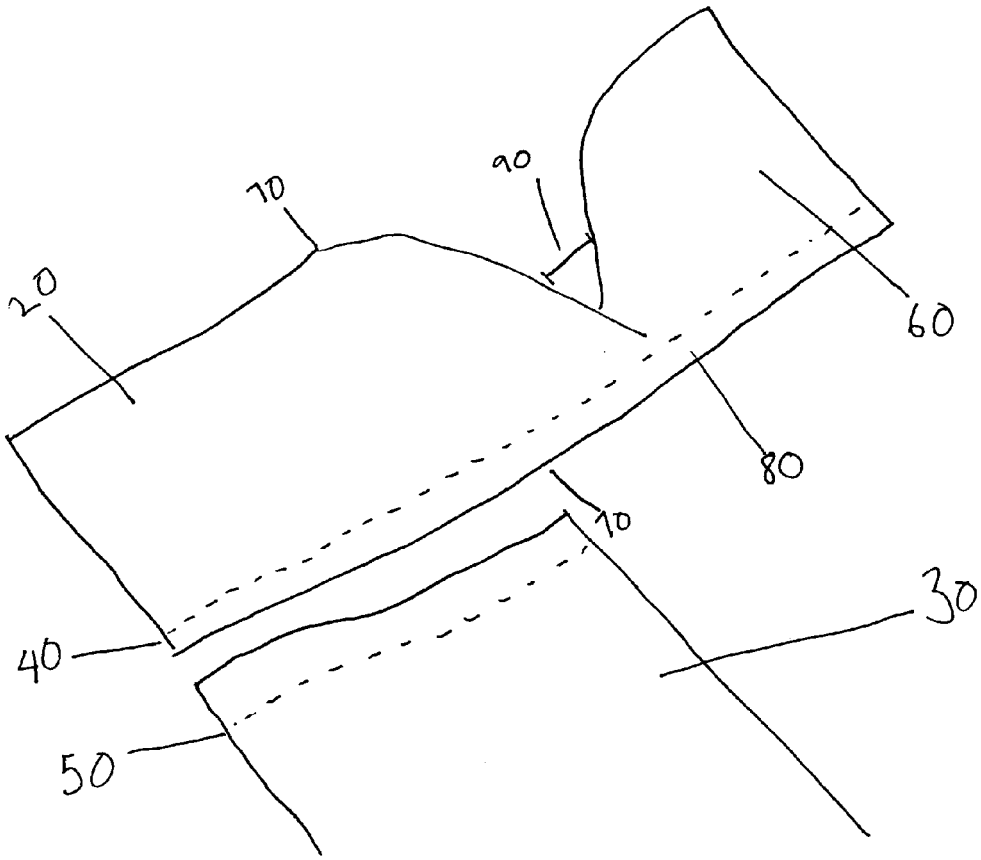
FIG. 2 shows the shoulder warming attachment in open position, and the sleeping bag in closed position.
Figure 3:
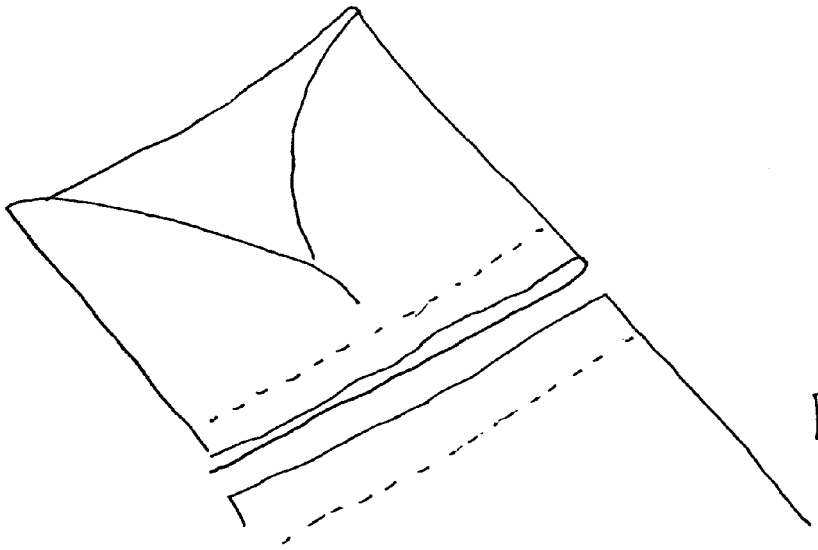
FIG. 3 shows the shoulder warming attachment in closed position, detached from the sleeping bag in closed position.

One embodiment of the elongated sleep covering is illustrated in FIGS. 1A and 1B. The sleeping bag consists of an ordinary rectangular sleeping bag (30) with a one half inch wide velcro loops fastener stitched several inches down from the top of the bag along the entire width of the interior (50). The sleeping bag extension (10), illustrated in FIG. 3, consists of an insulating material such as fleece or of a like and kind similar to that of the sleeping bag, cut roughly identical in width to the sleeping bag and a length about equal to that of an ordinary pillow. Said extension is folded in an overlapping fashion at the halfway point (70) identical to that of the sleeping bag to form a top piece (60) and bottom piece (20) similar to a sleeping bag, see FIG. 2. A separation in the top piece is cut using two curved lines from the top edge beginning at the far upper corners of the top piece towards the middle of the top piece, coming progressively closer. At the halfway point near the middle of the top piece (90), the distance between the arcs are approximately three to four inches apart, and arcs should meet at a point (80) about five to six inches above the sleeping bag's bottom line.

Figure 4:
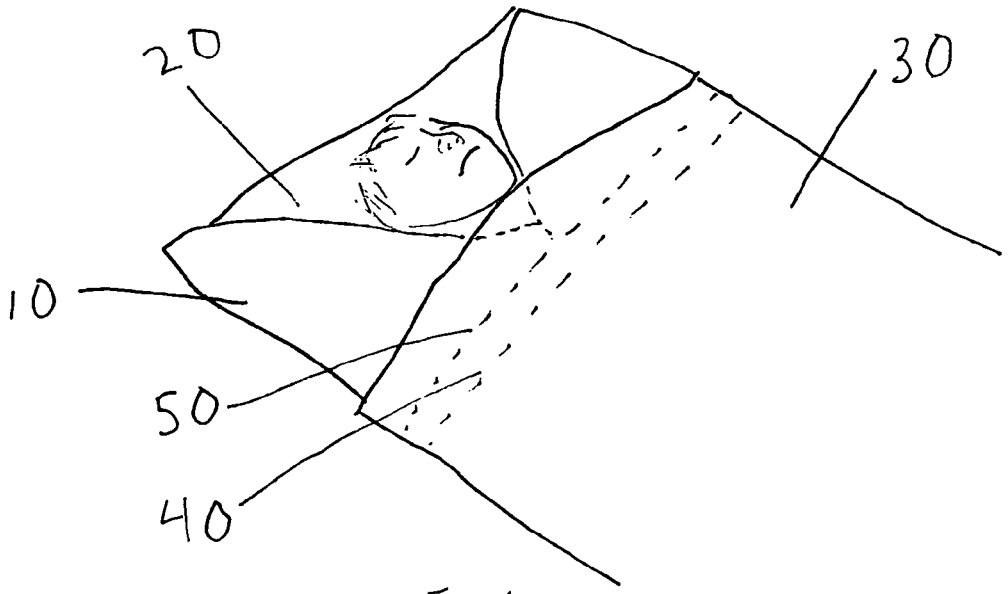
FIG. 4 shows the sleeping bag extension in closed position connected along the back side, front side of attachment is detached from sleeping bag, with sleeping bag pulled higher for additional warmth.

Said sleeping bag extension has one half inch wide velcro hooks fastener stitched several inches above the bottom (40), extending roughly the entire width of the piece. Once the piece is folded vertically a single time at the middle point (70), said extension should roughly mirror the width of the sleeping bag in closed position. Said piece is joined to the sleeping bag using the velcro fasteners on the piece and the sleeping bag (50). Once the extension is joined to the sleeping bag, the collective extension and sleeping bag operates in the same manner as an ordinary sleeping bag. If a pillow is being used, it should be placed in such a way that when the sleeping bag is closed with the piece attached, the pillow would be resting inside the piece in between the bottom and the top of the sleeping bag extension. An attempt should be made to have the top piece (60) resting flat on the sleep surface when in use to create the largest surface area of the top piece touching the sleep surface, or contact patch, as possible, see FIG. 4.

When the fastening mechanism between the sleeping bag extension and the sleeping bag remains disengaged during use, this allows the user to better adapt to the surrounding temperature. As the internal temperature in the bag drops, the user can pulling the bag further up the sleeping bag extension, thereby doubling the insulating material covering the user's shoulders. As the temperature inside the bag increases, the user has the option to extend her arms outside the sleeping bag to cool off while keeping the body core, including the shoulders, warm by maintaining the substantial contact patches above the shoulders.

ADDITIONAL EMBODIMENTS

Figure 5:
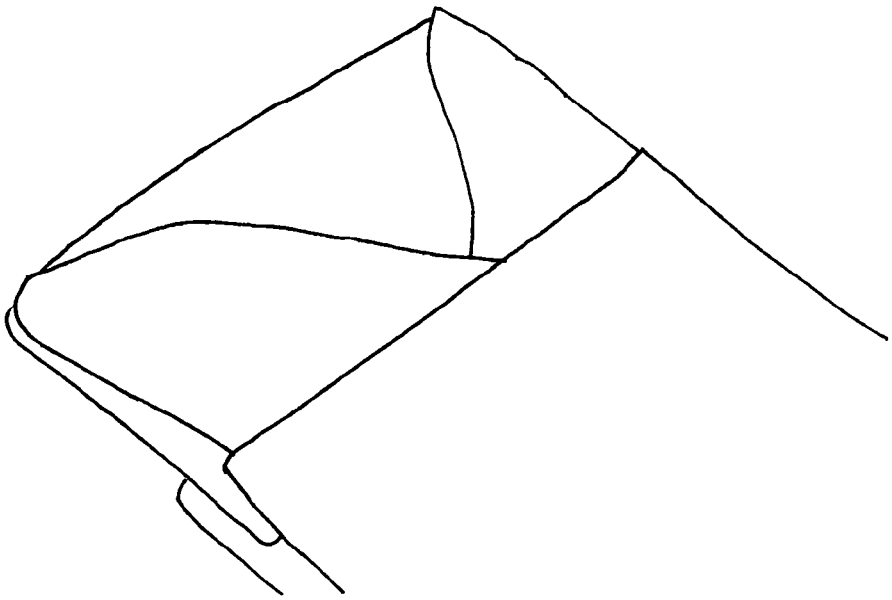
FIG. 5 shows the sleeping bag extension without fasteners and tucked into a sleeping bag.
Figure 6A:
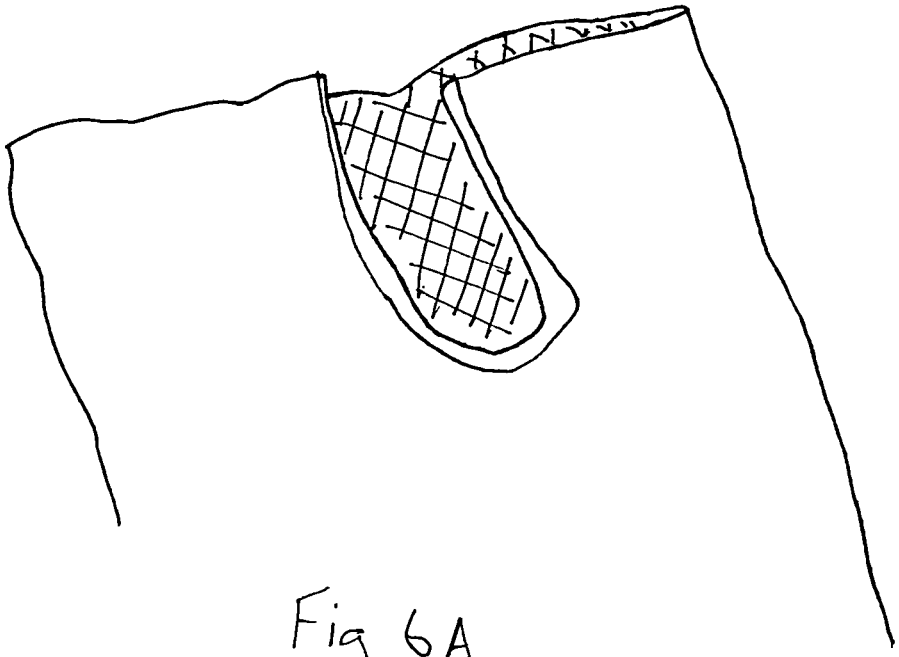
FIGS. 6A and 6B show multiple views of additional embodiment of sleeping bag with a permanent sleeping bag extension design with a U-shaped separation.
Figure 6B:
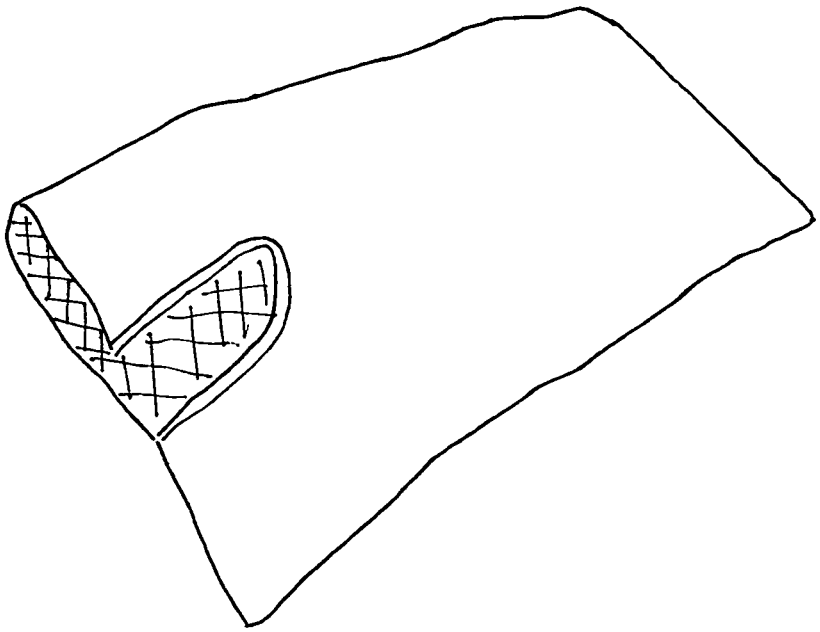

Additional embodiments are shown in FIGS. 5A and 5B; wherein the shoulder warming attachment and sleeping bag are either permanently attached or cut from the same fabric with varying separation shapes.

Additional embodiments include a shoulder warming attachment without a bottom piece, attaching only to the top of the sleeping bag.

Additional embodiments include a shoulder warming attachment piece without a means of attaching. This embodiment is designed to be used with a sleeping bag without a means of attaching, or a blanket.

ADVANTAGES

From the description above, a number of advantages of some embodiments of my shoulder warming sleeping bag become evident:

a. Prevents heat leakage and cold air infiltration from a rectangular or semi-rectangular sleeping bag by restricting air flow through the top opening of a sleeping bag.
b. Larger than incidental contact patches continue to restrict air flow into and out of the bag even when the user shifts into a position, such as sleeping on their side, that would ordinarily allow even more air flow through the top of the sleeping bag.
c. Allows sleeping bag manufacturer to use less insulation to achieve the desired temperature rating, thereby making the sleeping bag lighter weight and less expensive to manufacture.
d. Allows a sleep experience similar to an ordinary rectangular bag without the restrictiveness of the head covering and slender fit of a mummy bag.
e. Additional embodiments allow the user to better regulate temperature by extending arms outside of sleeping bag while keeping body core warm.

CONCLUSION, RAMIFICATIONS AND SCOPE

Accordingly, the reader will see that the shoulder warming sleeping bag of the various embodiments seals heat at the top of the sleeping bag, trapping heat and restricting air flow in and out of the sleeping bag. In addition, the shoulder warming attachment does not require the user to alter the method in which they use an ordinary rectangular sleeping bag, and allows the user multiple temperature regulating positions.

Although the description above contains many specificities, these should not be construed as limiting the scope of the embodiments but as merely providing illustrations of some of the several embodiments. For example, the separation in the top piece can have other shapes, such as a single slit, an elongated horse shoe, etc.; the length of the shoulder warming attachment can of varying lengths as well.

Thus the scope of the embodiments should be determined by the appended claims and their legal equivalents, rather than by the examples given.

The invention claimed is:

1. A sleep covering comprising:

1) a substantially planar insulating fabric top piece that is configured to lay above a user when in a horizontal resting position, that is further configured to extend beyond the user's ear line when in the resting position to create larger than incidental contact patches above the user's shoulder line, and wherein the top piece is configured to be wide enough above the shoulder line to create the contact patches; and 2) a separation in the top piece extending down from a top edge of the top piece by a minimum of five inches to define the contact patches, the separation comprising two convex edges beginning from the top edge at respective upper corners of the top piece and ending at a predetermined point near a middle of the top piece, wherein the predetermined point is configured to be disposed below the chin of the user in order to allow the user's head to protrude.

2. The sleep covering of claim 1, further comprising means for attaching the sleep covering to a sleeping bag or to a sleep surface.

* * * * *